US005908344A

United States Patent [19]

Kociemba

[11] Patent Number: 5,908,344

[45] Date of Patent: Jun. 1, 1999

[54] SPORTING IMPLEMENT PROTECTION AND SOUND-PRODUCING DEVICE

[75] Inventor: Bruce Kociemba, Poway, Calif.

[73] Assignee: Gazelle, Inc., Poway, Calif.

[21] Appl. No.: 09/015,569

[22] Filed: Jan. 30, 1998

[51] Int. Cl.[6] ..... A63H 3/28; A63H 5/00; A63J 19/00; A65D 65/02

[52] U.S. Cl. ..... 446/297; 446/302; 446/71; 446/81; 446/366; D21/754; 150/160

[58] Field of Search ..... 446/297, 299, 446/302, 303, 484, 71, 72, 73, 74, 76, 81, 366; D21/754; 206/315.4; 150/159, 160; 473/282

[56] References Cited

U.S. PATENT DOCUMENTS

| | | | |
|---|---|---|---|
| D. 287,392 | 12/1986 | Brittner et al. | D21/754 |
| D. 297,448 | 8/1988 | Thawlay et al. | D21/754 |
| 2,627,699 | 2/1953 | Schuettenhelm et al. | 446/297 |
| 4,516,950 | 5/1985 | Berman et al. | 446/297 X |
| 4,525,878 | 7/1985 | Lowe, Jr. . | |
| 4,540,176 | 9/1985 | Baer | 446/302 X |
| 4,702,140 | 10/1987 | Goldfarb . | |
| 4,734,074 | 3/1988 | Kinberg et al. . | |
| 4,820,233 | 4/1989 | Weiner . | |
| 4,840,371 | 6/1989 | Harris . | |
| 5,259,807 | 11/1993 | Crowe . | |
| 5,279,514 | 1/1994 | Lacombe et al. | 446/297 |
| 5,376,038 | 12/1994 | Arad et al. | 446/297 |

*Primary Examiner*—D. Neal Muir
*Attorney, Agent, or Firm*—John F. Klos; Larkin, Hoffman, Daly & Lindgren

[57] ABSTRACT

A head cover or similar protective article for a sporting implement, particularly a golf club, is disclosed having a sound-generating device for producing sounds which are thematically linked to the decorative or artistic aspects of the cover. The sound generating device may emit music or other sounds (such as simulated voices) when activated by a switch. The sound generating device may be powered by a battery or photoelectric cell. The switch may assume a variety of configurations, and be positioned in a variety of locations on or remote from the head cover. The head cover may include an ornamental or configured portion which resembles or caricaturizes one or more renowned personalities, creatures, or entities. The particular emitted tune or other voice sound may be coordinated in theme to the personality, creature, or entity configured on a portion the head cover. Similarly, a plurality of head covers may be provided, each having differently configured portions which are together related in theme or association.

26 Claims, 5 Drawing Sheets

SPORTING IMPLEMENT PROTECTION AND SOUND-PRODUCING DEVICE

BACKGROUND OF THE INVENTION

1. Field of the Invention

This invention relates generally to sound-generating ornaments, novelties, toys and other amusement devices, and particularly to such items associated with a sporting implement cover or protection device.

2. Brief Description of the Prior Art

A variety of ornaments, novelties and toys with digital-logic integrated circuits that excite acoustic speakers have been developed. Well known to those skilled in the art are various techniques for implementing such circuits to develop a controlled series of electrical oscillations that correspond to musical tunes, or even to more elaborate sounds such as simulated speech. These oscillations may be directed to a conventional acoustic speaker or small piezo-electric disc, where they are converted into acoustic vibrations and audible sounds. These circuits require small batteries, or may be powered by photoelectric cells (commonly termed "solar cells") which generate electricity whenever adequate light impinges upon them. User activation of these devices to generate sound may be through any conventional manner (i.e. switch, timer, remote control device, etc.)

Also well known are protective head coverings for sporting implements, such as golf clubs, which generally encompass at least a portion of the implement and offer protection against damage and normal wear and tear. For golf clubs in particular, such head covers may be generally sock-like, having an elongated body and an opening through which the club head is inserted during placement. Head covers may also include various types of ornamental, decorative, advertising or commercial content.

SUMMARY OF THE INVENTION

The device of this invention is a sporting implement cover or protection apparatus which emits a simulated or synthesized voice or other sounds when activated by a user. Briefly described, a sporting implement cover according to the present invention includes a body which has an ornamentally- or decoratively-configured portion, and a device for generating and emitting sounds upon activation by the user. In one embodiment, the configured portion of the body and the generated sounds are related together in some distinct theme or manner. For example, the body may be in the form of an animal with an appropriate animal sound being emitted, or the body may assume the form of a renowned fictional or nonfictional personality with the appropriate simulated voice being emitted.

Another part of the invention is a switch means for activating (mechanically and/or electrically) the sound- or voice-emitting circuitry. The sound-generating device may be housed within a chassis and removably secured within an inner compartment of the body. The sound-generating device may be powered from batteries which are secured to the chassis.

In another embodiment, a plurality of sporting implement covers are provided, each having a distinctly configured, though thematically interrelated, portion which resembles a renowned or recognizable personality, and each having a device for generating and emitting corresponding voice sounds.

DETAILED DESCRIPTION OF THE PREFERRED EMBODIMENTS

Figure 1:
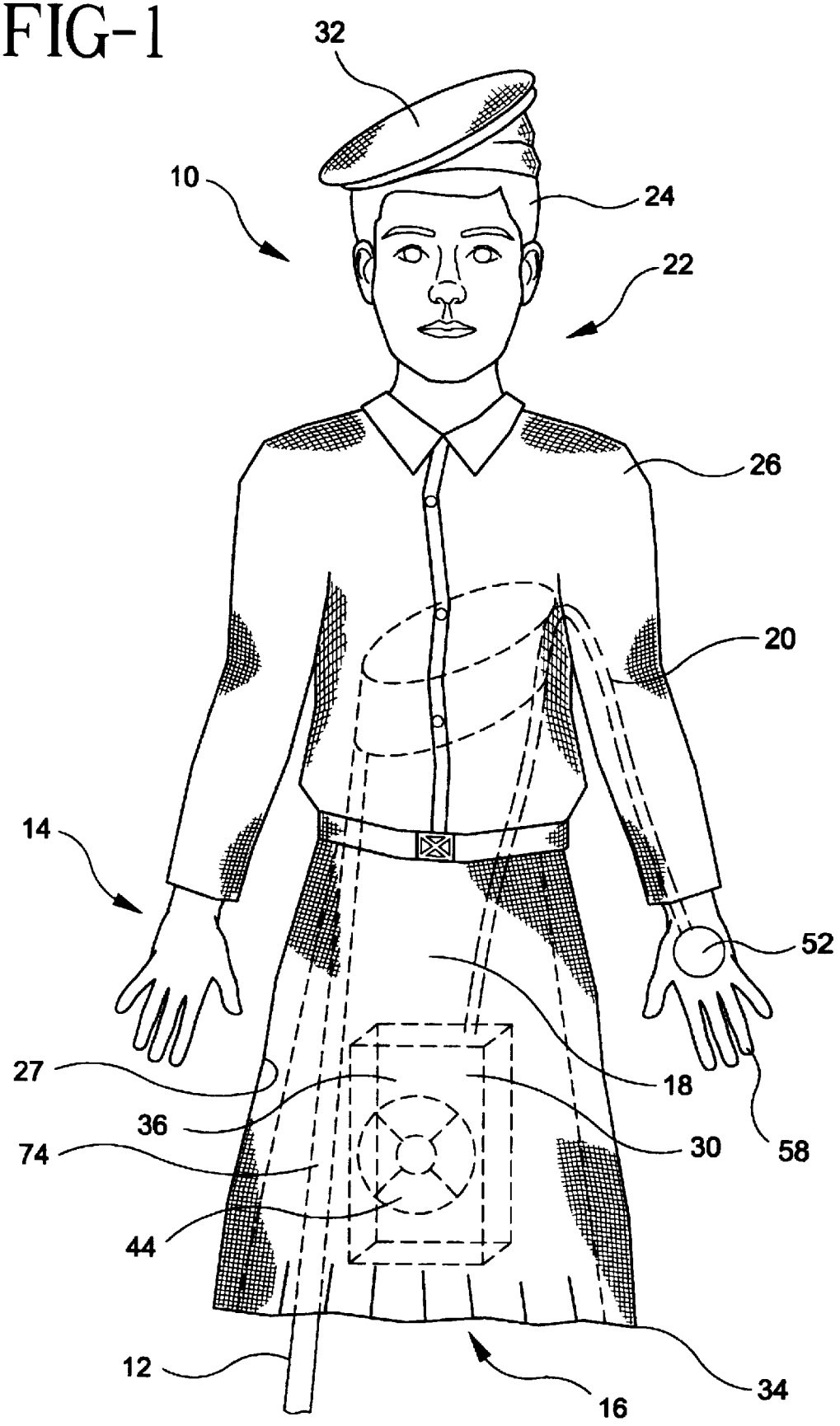
FIG. 1 is perspective view of the head protective cover of the present invention shown in position atop a golf club.

Referring more specifically to the drawings, and to FIG. 1 in particular, numeral 10 designates generally a cover device for a sporting implement according to the present invention. The cover device 10 shown in the drawings is a representative example for use with a standard golf club 12; however, it will be readily appreciated by those skilled in the art that the present invention may be suitable for other sporting implement protecting covers or devices, such as a tennis racquet cover, bowling ball carrying bag, gun or rifle case, or billiard cue case. These and other sporting implements are capable of being utilized in well known manners. It is also appreciated that un-utilized (stored, transported, etc.) sporting implements may be desirably protected from damage through wear and tear by covering or encompassing at least a portion of the implement with a protective device. The sporting implement and protective device are typically separated prior to user utilization of the sporting implement. Furthermore, while one representative configuration of the structure, components, and mechanisms of this invention will be described in detail based upon their proven suitability for this application, it is understood that a wide variety of know and hereafter developed equivalents and alternatives may be substituted for certain components to achieve similar function and corresponding advantages in this application.

Referring particularly to FIG. 1, the cover device 10 will normally include a body 14 having an aperture 16 which leads into an inner cavity 18 for receiving at least a portion of the associated sporting or recreational implement 12. In the illustrated embodiment for golf clubs 12, the cover device 10 is generally sock-like, having an elongated body 14 and an access aperture 16 sized to receive the club end portion 20 of a golf club 12.

The body portion 14 of the cover device 10 includes a decorative or ornamental configured portion 22, which may be artistically rendered. In the illustrated embodiments, the configured portion 22 includes the head 24 and torso portion 26 of a human. Alternatively, the configured portion 22 may depict an animal, cartoon figure, mythical figure, or other generally readily recognizable person or thing. The cover device 10 further has a sound generating device 30 described herein. A voice, tune, or other sounds may be produced or otherwise generated by the sound generating device 30 and can, in some manner, be associated with or appropriate for either the configured portion 22 or the type of sporting implement 12 which the device 10 covers.

Still referring to FIG. 1, the body portion 14 of the cover device 10 has a substantially closed upper end 32, and a lower end 34 defining an access aperture 16 suitably sized to receive at least a portion of the golf club 12 therethrough and into the inner cavity 18. Inner cavity 18 is defined between aperture 16 and the interior surfaces 27 of the elongate body 14. The body portion 14 is formed to resemble a head 24 and clothed torso 26 of a human.

Figure 2:
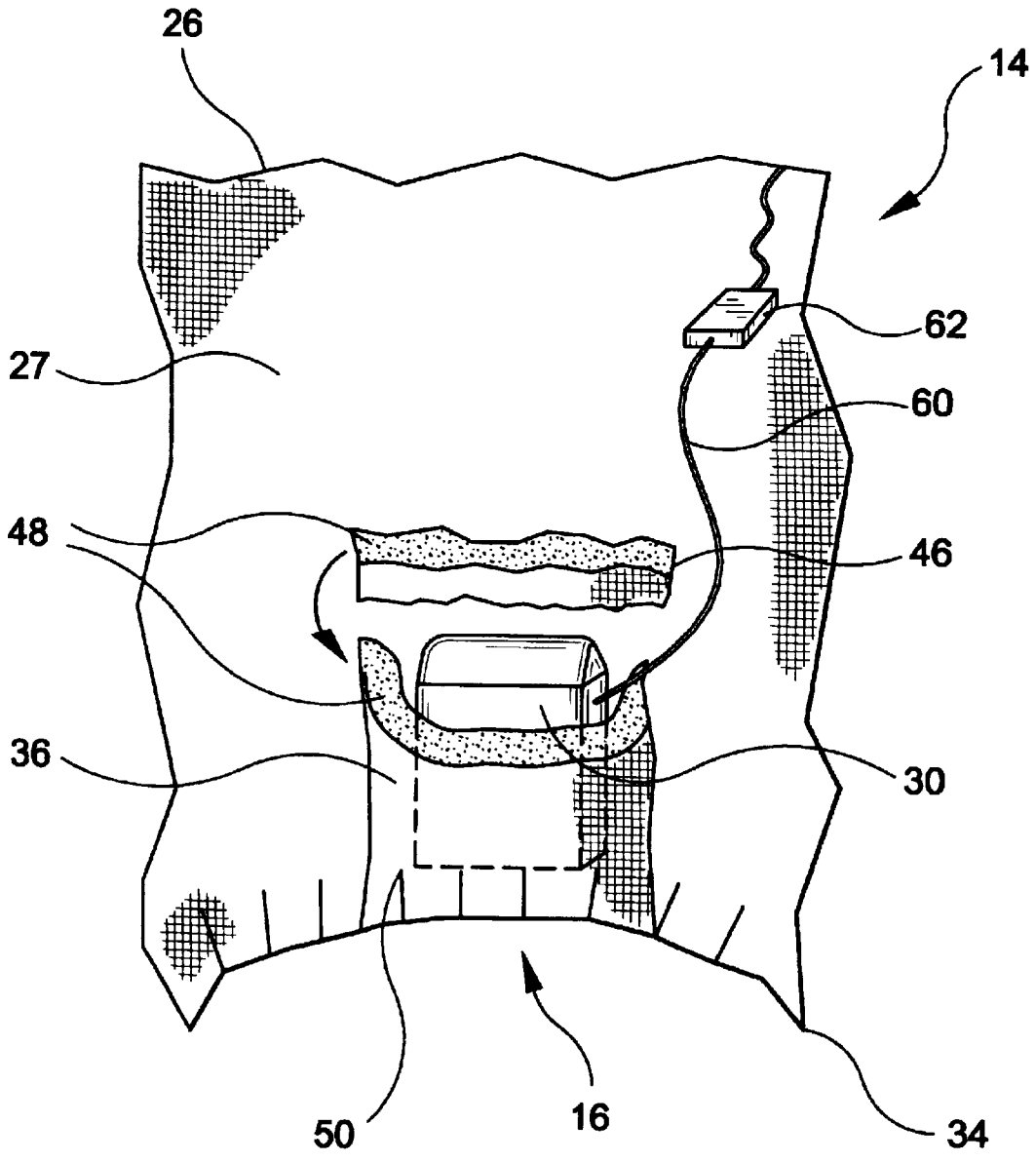
FIG. 2 is side view of a partially-revealed lower portion of the head protective device of FIG. 1.
Figure 3:
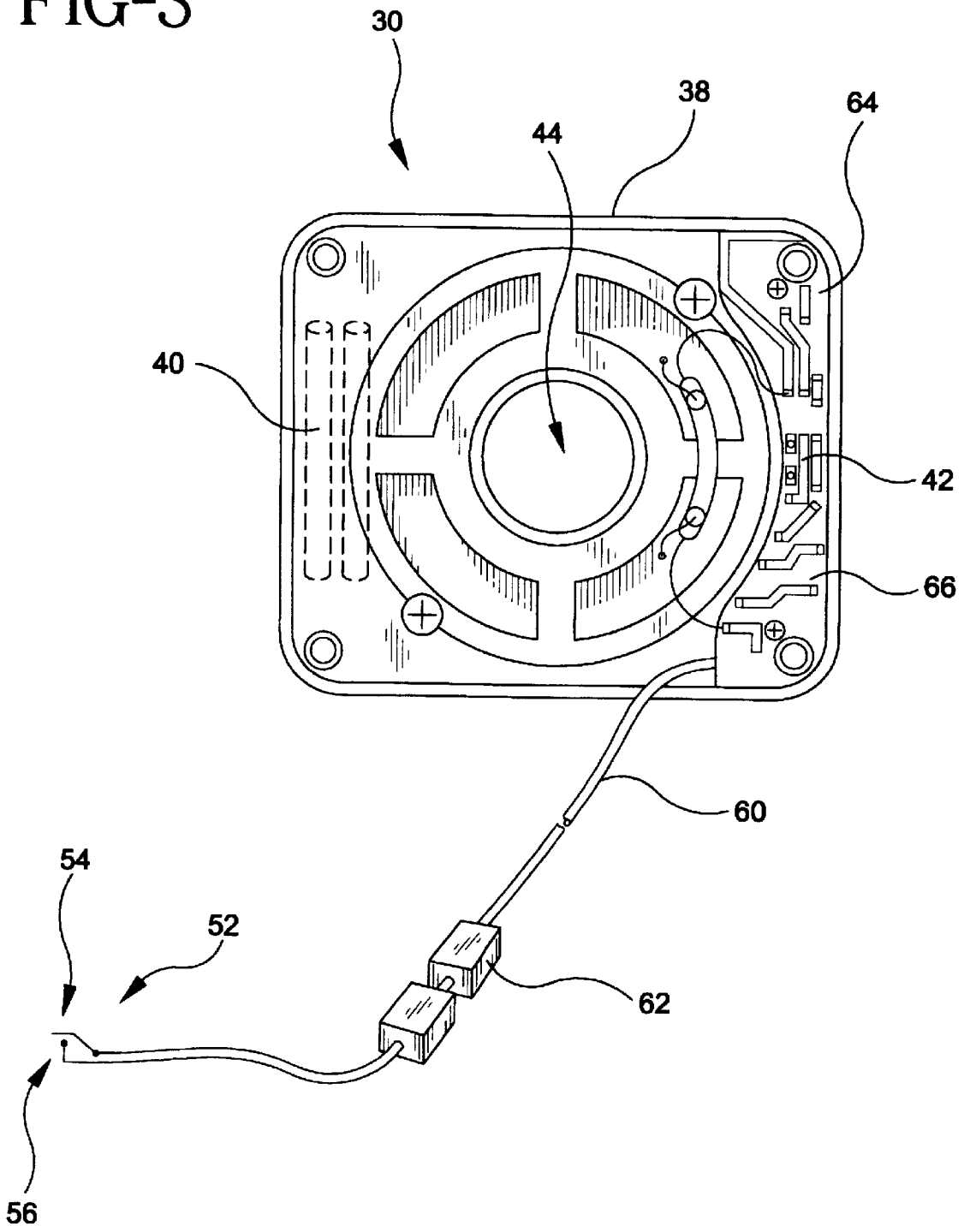
FIG. 3 is a partially broken away side view of a sound-generating device of the cover of FIG. 1.

Referring now to FIGS. 1, 2, and 3, the cover device 10 includes a compartment 36 in the body portion 14 for securing the sound-generating device 30 within the inner cavity 18. The sound generating device 30 is inconspicuously secured within the compartment 36, as shown in FIG. 1, and includes a chassis 38, a suitable power source 40 such as batteries or a small solar unit, a programmed electronic chip 42, and a speaker unit 44. Referring to FIG. 2, the sound generating device 30 may be secured within the compartment 36 in any suitable manner, a preferred method being the use of a flap 46 and releasable hook-and-loop material 48. The flap 46 is designed to provide access to the sound-generating device 30 for changing batteries 40, for example, or for removing a particular sound-generating device 30 and inserting another. The compartment 36 may be formed on the device 10, either by separating the multiple layers which form the device 10, or by adding a cover or pocket 50 of suitable size to the interior 18 of the device 10.

The sound-generating device 30 is activated by the user through a switch 52, which may be secured to the chassis 38, positioned on the body 14, or constitute a remote controlled device for remotely operating the sound-generating device 30. Switch 52 has normally separated contact arms 54, 56 for activating the sound generating device 30. The arms 54, 56 may be disposed, as shown in FIGS. 1 and 2, within a hand portion 58 of the device 10. The contact arms 54, 56 are sensitive to a slight pressure, such that a light touch applied to the device 10 in the vicinity of its hand 58 will deflect the contact arms 54, 56 into engagement. It is not necessary to maintain the contact between arms 54, 56, as the device 10 begins to play its sounds upon activation and continues to play as programmed. Switch 52 is connected to the chassis 38 of the sound generating device through conductors 58. Conductors 58 may be coupled together through male/female connector 62, which may allow the user to completely detach the sound generating device 30 from the body 14.

Referring now to FIG. 3, a particular sound-generating device 30 is illustrated. The sound generating device is housed within a chassis 38 and includes a programmed electronic chip 42 mounted on a small printed circuit board 64 and electrically connected to discrete devices 66, battery pack 40, and speaker unit 44. Switch lines 60 pass through chassis 38 and extend to switch 52 through connector 62. Those skilled in the art will appreciate alternative appropriate circuitry and componentry for the sound-generating device 30. A variety of sounds, voices, tunes, etc. may be programmed into the sound-generating device 30 and can be, in some recognizable way, associated with or appropriate for the configured portion 22 for which it is intended. For example, the configured portion 22 of the body 14 may resemble an animal and the sound-generating device 30 would emit appropriate animal calls. Or, the configured portion 22 may include humorous, ethnic, religious, commercial, or political content, and the sounds emitted would be related in theme. Furthermore, multiple sounds, voice phrases, or tunes may be generated by the sound generating device 30.

As a result, one aspect of the present invention is a sporting implement protection device 10 which has a distinctively configured portion 22 and a sound device 30 for emitting sounds, voices, or tunes which are recognizably associated with the configured portion 22.

In use and operation, the head cover 10 of the illustrated embodiment is placed upon the golf club 12 by inserting the club head 20 through the aperture 16 and into the inner implement receiving cavity 18. As illustrated in FIG. 1, the device 10 covers the head 70 of the golf club 12 and a portion of the club shaft 74. Upon sufficient contact by the user to trigger switch 52, the sound generating device 30 will produce a desire voice phrase which is desirably associated with the configured portion 22 of the cover 10. Prior to use of the golf club 12, the device is simply removed by pulling the shaft 71 and head 70 away from the device 10.

Figure 4:
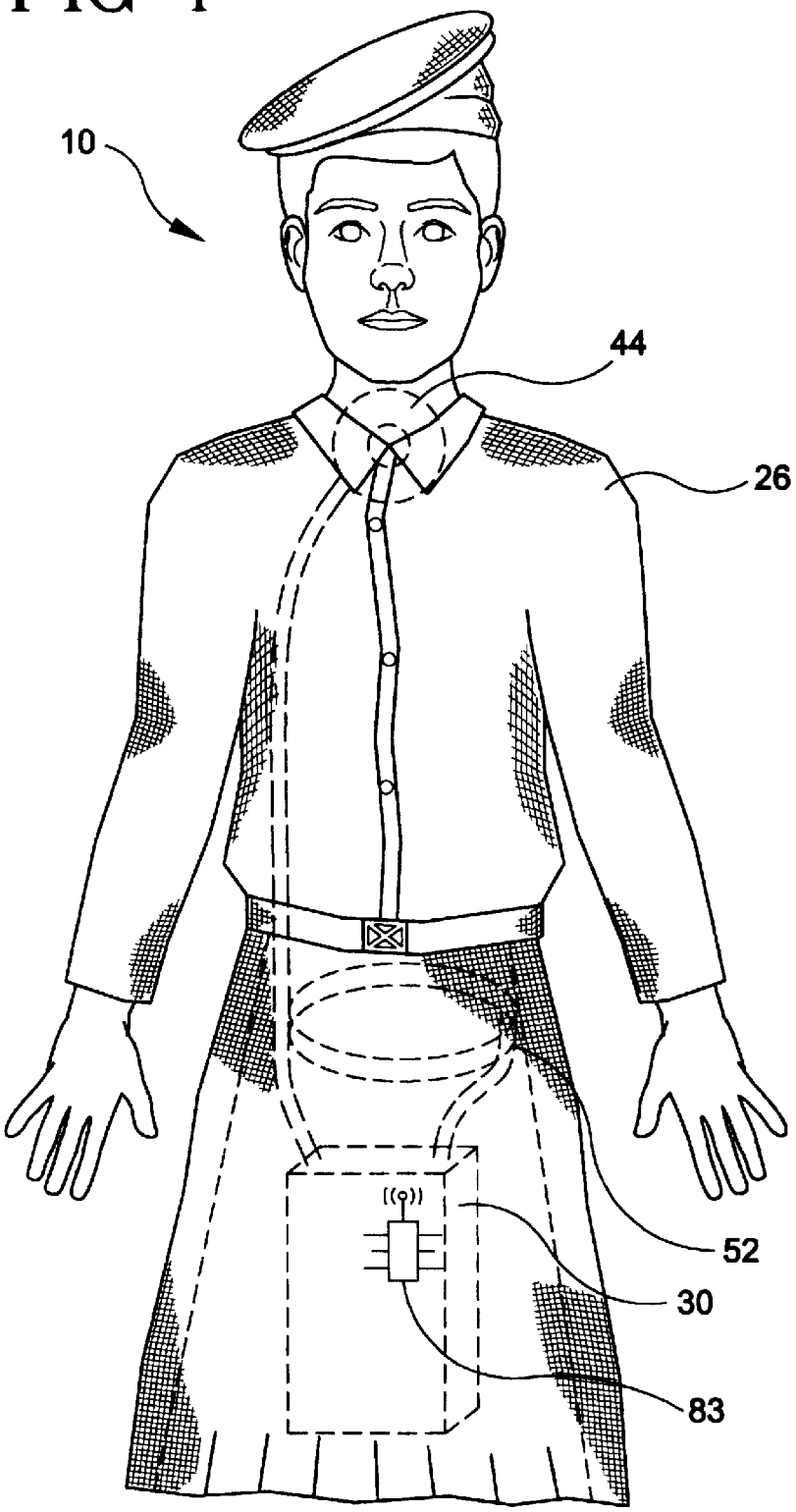
FIG. 4 is perspective view of a second embodiment of the head protective device of the present invention.
Figure 4A:
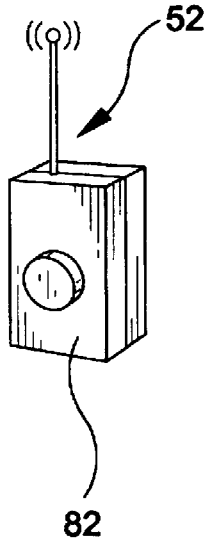
FIG. 4A is a perspective view of a remote transmitter device.

Referring now to FIG. 4, another embodiment of the device 10 is illustrated. Sound-generating device 30 may include a remotely mounted speaker unit 44, the speaker unit 44 being positioned between the head 24 and torso 26 regions of the configured portion 22. Similarly, a variety of switch mechanisms 52 may be used to trigger or initiate the sound-generating device 30. Switch 52 may be triggered by the user grasping and removing the club 12 from the protective cover 10. Alternative switching concepts are readily appreciated to those skilled in the art. Still referring to FIG. 4, the switch means 52 may alternatively be remotely triggered by user activation of a remote control device having a transmitter 82, as shown in FIG. 4A, and receiver 83 device. Such remote control devices 82, 83 are well known to those skilled in the art.

Figure 5:
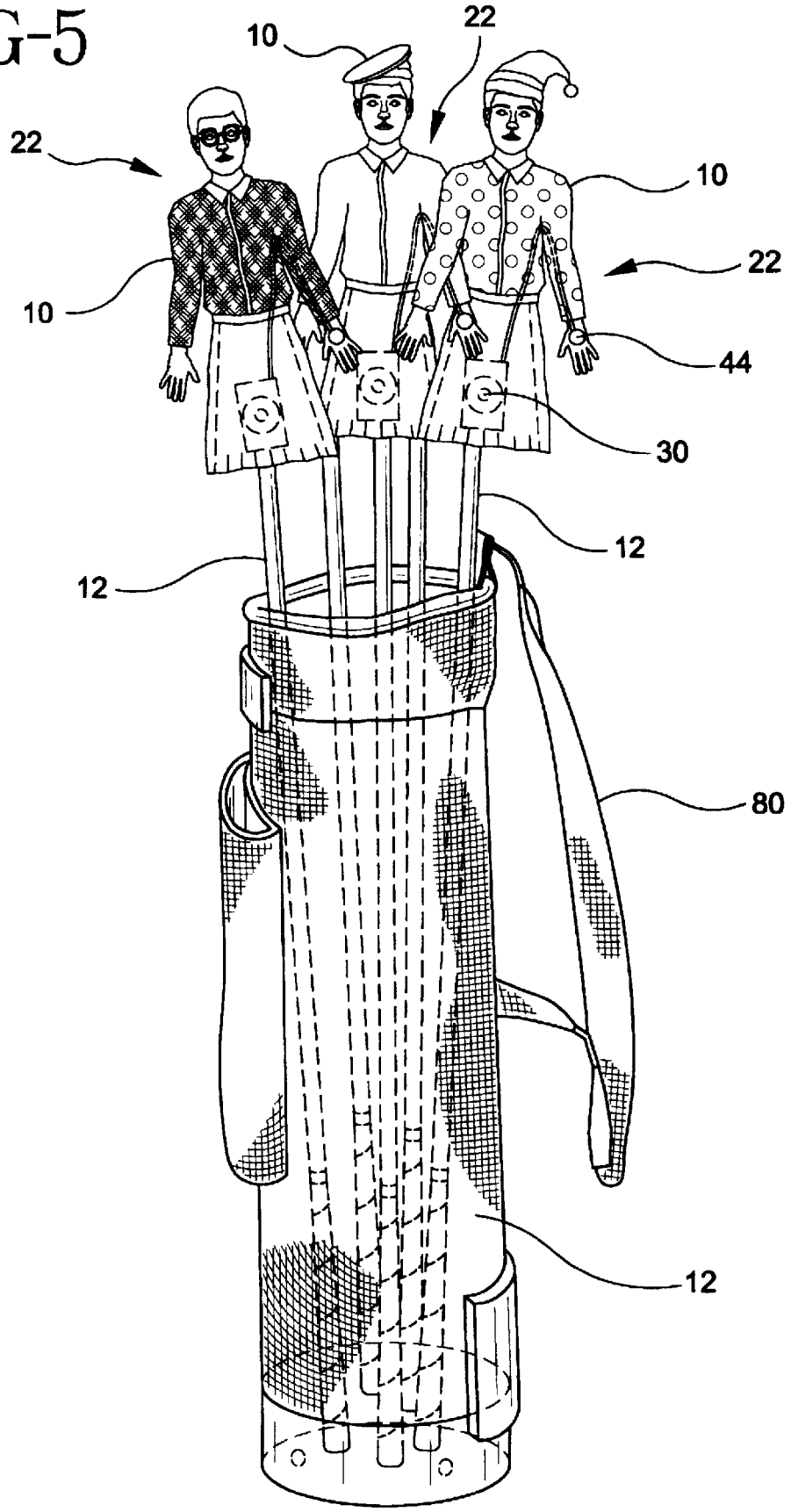
FIG. 5 is a perspective view of a group of head protective devices according to FIG. 1, each shown in position atop a golf club.

Now referring to FIG. 5, a plurality of devices 10 are shown grouped together with a set of golf clubs 12 and a golf bag 80. Three devices 10 according to the present invention are shown in position atop separate golf clubs 12. Each configured portion 22 may be distinctive in style, shape, design, etc. As illustrated, the configured portions 22 of the trio of devices 10 depicts human heads 24 and clothed torsos 26. As described above, the sound-generating device 30 of each device 10 may generate a simulated voice which is readily associated with the depicted human 22. Furthermore, configured portions 22 of the plurality of devices 10 may be related to each other in theme, content, or other association. A duo or trio of devices 10 according to the present invention may depict an entertainment, celebrity, or other group of persons which may be readily recognizable from both the ornamental configured portions 22 and the voices emitted from the sound generating devices 30.

In the claims, the use of the term "thematic" is defined to mean of, constituting, or relating to a theme or implicit or recurrent idea. Examples of a theme include a motif, or often repeated song or voice identified with a person, place, or thing. The phrase "thematically related", as used in the claims means producing in the mind of the person viewing the device(s) and hearing the sound(s) emitted therefrom a particular association, memory, relationship, or impression intended and designed to induce a desired reaction or response. The phrase "sporting implement" as used in the claims means portable personal property, typically capable of being hand-held, or otherwise human body attached, affixed, grasped, or manipulated and which may be used for, in, or during a sporting, recreational, amusement, athletic, or physical-therapeutic event, game, or other activity.

While the preferred embodiments of the above sport implement protection device have been described in detail with reference to the drawings, it is understood that various changes, modifications, and adaptations may be made to the device or its method of operation or range of applications without departing from the spirit and scope of the appended claims.

What is claimed is:

1. A protective sound emitting novelty device for use with a sporting implement, said device comprising:

a body structure having an elongated fabric portion defining an access aperture and an interior cavity for receiving at least a portion of the sporting implement, said body structure further having a configured portion; and a sound-generating device for generating sounds, said sound-generating device removeably-secured to the body structure by a securement structure, said securement structure being a fabric pocket compartment for receiving at least a portion of the sound-generating device, said securement structure being attached within the interior cavity of the body structure, said sound-generating device including a chassis and at least one programmed electronic chip, and at least one associated switch means wherein the switch means is adapted to activate said sound-generating device by at least one of: (a) pressure to a portion of the body structure, (b) a remote device having a transmitter; or (c) removal of the at least a portion of the sporting implement from the interior cavity; and a connector configured to allow the sound-generating device to be disconnected from at least one of the switch means.

2. The device of claim 1 wherein the generated sounds are thematically related to the configured portion of the body structure.

3. The device of claim 1 wherein the configured portion resembles at least a portion of a human being.

4. The device of claim 3 wherein the generated sounds are simulated human voices.

5. The device of claim 4 wherein the generated sounds include at least two different human voices.

6. The device of claim 5 wherein the sporting implement is a golf club having a club head and a shaft, wherein the body structure is generally elongate and sized to receive said club head and a portion of said shaft.

7. The device of claim 6 wherein the sound-generating device includes a chassis, an integrated chip, one or more batteries, and a speaker unit for transmitting sound.

8. The device of claim 7 wherein the speaker unit of the sound-generating device is housed within the chassis.

9. The device of claim 1 wherein the switch means is a switch having arms which contact in response to a user's touch.

10. The device of claim 1 wherein the switch means is a switch having arms which contact in response to a user grasping and removing the device from the sporting implement.

11. The device of claim 1 wherein the switch means is a device for remotely controlling the sound-generating device.

12. A protective sound emitting novelty device according to claim 1, wherein the securement structure includes the pocket compartment and a flap structure.

13. An article of manufacture comprising:

a golf club;

a body structure for encompassing at least a portion of the golf club, said body structure having an elongated fabric portion defining a lowermost access aperture and an interior cavity for receiving at least a portion of the golf club, said body structure having a fabric pocket compartment secured within the interior cavity, said body structure having a configured portion which contains generally recognizable visual content and resembling at least a portion of a fictional character; and a device for emitting sounds which is associated with said fictional character and operatively associated with said body structure, said device being sized to be received into the pocket compartment to secure the device to the body structure said device adapted to be activated through a switch means configured to be activated by at least one of: (a) pressure to a portion of the body structure, (b) a remote device having a transmitter; or (c) removal of the at least a portion of the golf club from the interior cavity.

14. The article of claim 13 wherein the configured portion resembles at least a portion of a human form.

15. The article of claim 14 wherein the device emits sounds which are recognizable as simulated human voices.

16. The article of claim 13 wherein the switch means is a switch having arms which contact in response to a user's touch.

17. The article of claim 13 wherein the switch means is a switch having arms which contact in response to a user grasping and removing the device from the sporting implement.

18. The article of claim 13 wherein the switch means is a remote control device for remotely controlling the activation of the sound-emitting device.

19. The article of claim 13 wherein the generated sounds include at least two different sounds.

20. The article of claim 13 wherein the generated sounds are thematically related to the configured portion of the body structure.

21. An article of manufacture for a sporting implement which may be utilized by a human, said article comprising:

a body structure which is capable of being removably secured to a sporting implement, said body structure having an elongated fabric portion defining a lowermost access aperture and an interior cavity for receiving at least a portion of the sporting implement, said body structure having a configured portion which contains generally recognizable visual content;

a device for emitting sounds adapted to be activated by at least one switch means, said sound emitting device secured to the body structure by a securement structure said securement structure having a fabric pocket compartment attached to the body structure within the interior cavity, said sound generating device configured to be activated by at least one of: (a) a removal of the at least a portion of the sporting implement from the interior cavity of the body structure; (b) a remote device having a transmitter; or (c) pressure to a portion of the body structure; and a connector configured to allow the sound generating device to be disconnected from at least one of the switch means.

22. The article of claim 21 wherein the emitted sounds are thematically related to the configured portion of the body structure.

23. The article of claim 21 wherein the emitted sounds are simulated human voicings.

24. The article of claim 21 wherein the configured portion resembles a human form.

25. A plurality of articles of claim 21, wherein the configured portions of the articles are thematically related.

26. An article of manufacture according to claim 21, wherein the securement structure includes the pocket compartment and a flap structure.

* * * * *